US008828634B2

(12) United States Patent
Sugitate

(10) Patent No.: US 8,828,634 B2
(45) Date of Patent: Sep. 9, 2014

(54) ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

(75) Inventor: Atsushi Sugitate, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 85 days.

(21) Appl. No.: 13/223,957

(22) Filed: Sep. 1, 2011

(65) Prior Publication Data

US 2012/0189950 A1 Jul. 26, 2012

(30) Foreign Application Priority Data

Jan. 21, 2011 (JP) ..... 2011-011068

(51) Int. Cl.
*G03G 9/08* (2006.01)
*G03G 15/08* (2006.01)
*G03G 9/097* (2006.01)

(52) U.S. Cl.
CPC ..... *G03G 9/09708* (2013.01); *G03G 15/0879* (2013.01)
USPC ..... 430/108.6; 399/252

(58) Field of Classification Search
USPC ..... 430/105, 108.6; 399/111, 252
See application file for complete search history.

(56) References Cited

U.S. PATENT DOCUMENTS

| | | | | |
|---|---|---|---|---|
| 4,943,506 | A | 7/1990 | Demizu et al. | |
| 6,114,077 | A | 9/2000 | Voets et al. | |
| 6,355,390 | B1 * | 3/2002 | Yamanami et al. | 430/60 |
| 6,852,460 | B2 * | 2/2005 | Nakayama et al. | 430/108.6 |
| 2005/0100807 | A1 * | 5/2005 | Yamazaki et al. | 430/108.6 |
| 2011/0159422 | A1 * | 6/2011 | Nakamura et al. | 430/105 |
| 2012/0148948 | A1 * | 6/2012 | Ikeda et al. | 430/108.3 |

FOREIGN PATENT DOCUMENTS

| | | |
|---|---|---|
| JP | A-01-105962 | 4/1989 |
| JP | A-06-186787 | 7/1994 |
| JP | A-2000-056514 | 2/2000 |
| JP | A-2000-128534 | 5/2000 |
| JP | A-2002-214826 | 7/2002 |
| JP | A-2003-248338 | 9/2003 |
| JP | A-2004-018671 | 1/2004 |
| JP | A-2007-033719 | 2/2007 |

* cited by examiner

*Primary Examiner* — Mark A Chapman
(74) *Attorney, Agent, or Firm* — Oliff PLC

(57) ABSTRACT

The electrostatic charge image developing toner includes a colorant containing rutile type and anatase type titanium oxides, and a binder resin.

19 Claims, 1 Drawing Sheet

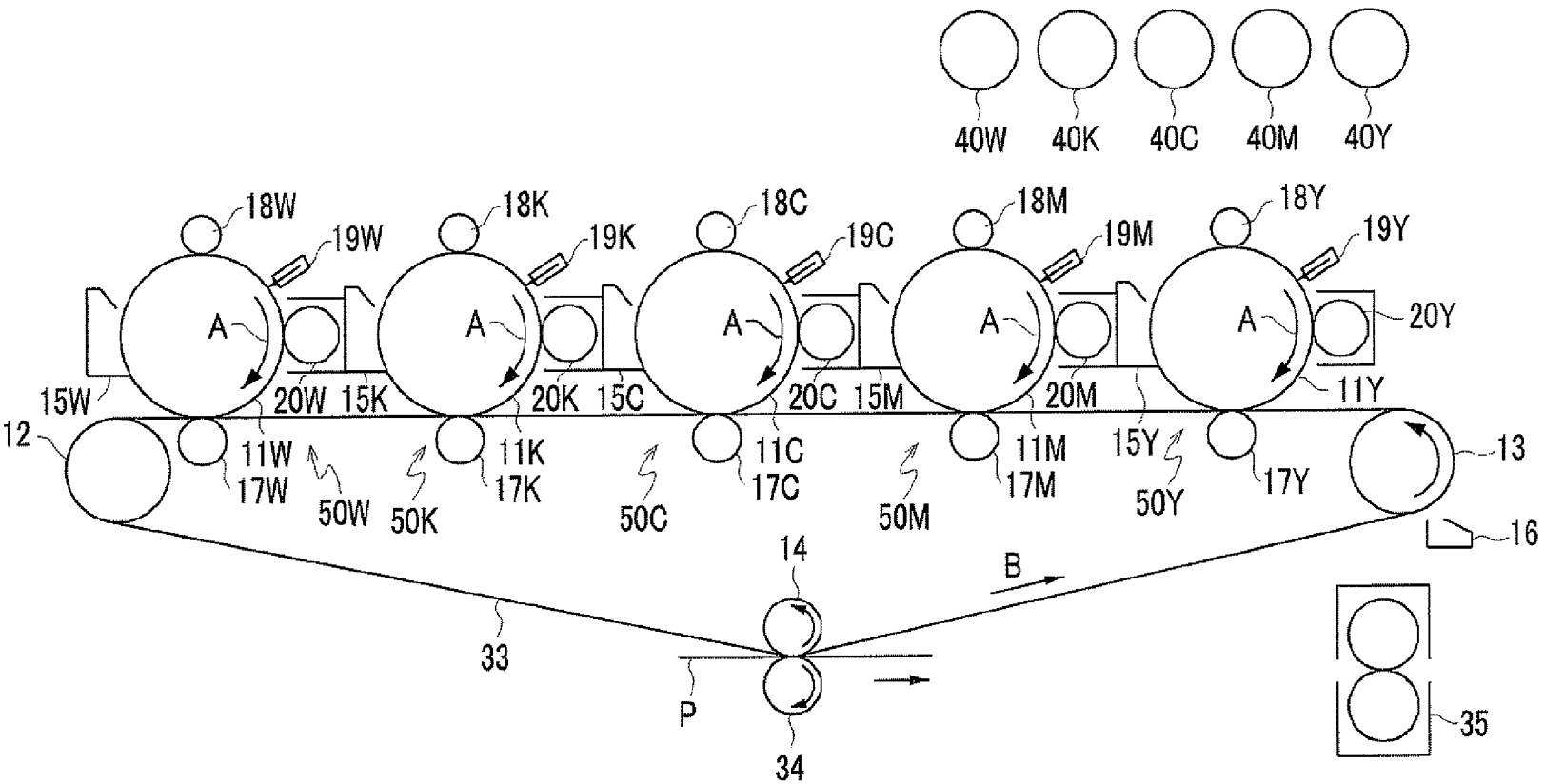
40Y
40M
40C
40K
40W
18Y
19Y
20Y
11Y
17Y
15Y
50Y
18M
19M
20M
11M
17M
15M
50M
18C
19C
20C
11C
17C
15C
50C
18K
19K
20K
11K
17K
15K
50K
18W
19W
20W
11W
17W
15W
50W
A
B
P
12
13
14
16
33
34
35

ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2011-011068 filed on Jan. 21, 2011.

BACKGROUND

1. Technical Field

The present invention relates to an electrostatic charge image developing toner, an electrostatic charge image developer, a toner cartridge, a process cartridge, an image forming apparatus, and an image forming method.

2. Related Art

In recent years, due to the development of equipment and the complete establishment of a communications network in an information-oriented society, a electrophotography process is widely used not only in a copy machine, but in a network printer in offices, a personal computer printer, a printer of on-demand printing, and the like. Regardless of monochromatic or color printing, high image quality, high speed, high reliability, miniaturization, weight reduction, and energy saving properties for the electrophotography process are being required with an increasingly higher degree.

Generally, in the electrophotography process, a fixed image is formed through plural processes including electrically forming an electrostatic charge image through various units on a photoreceptor (a latent image holding member) using an optical conductive material, developing the electrostatic charge image by using a toner, transferring a toner image on the photoreceptor to a recording medium such as paper or the like directly or through an intermediate transfer member, and then fixing the transferred image on the recording medium.

SUMMARY

According to an aspect of the invention, there is provided an electrostatic charge image developing toner including a binder resin and a colorant, wherein the colorant includes a rutile type titanium oxide and an anatase type titanium oxide.

BRIEF DESCRIPTION OF THE DRAWING

Exemplary embodiments of the present invention will be described in detail based on the following FIGURE, wherein:

FIG. 1 is a schematic configuration view illustrating an example of an image forming apparatus according to an exemplary embodiment of the invention.

DETAILED DESCRIPTION

Hereinafter, an electrostatic charge image developing toner, an electrostatic charge image developer, a toner cartridge, a process cartridge, an image forming apparatus, and an image forming method according to an exemplary embodiment of the invention will be described in detail.

<Electrostatic Charge Image Developing Toner>

The electrostatic charge image developing toner (hereinafter, simply referred to as a "toner" in some cases) according to the exemplary embodiment contains a colorant including a rutile type titanium oxide and an anatase type titanium oxide; and a binder resin. The toner of the exemplary embodiment is suitably used as a white toner.

According to the knowledge of the present inventors, the rutile type titanium oxide is excellent in lightfastness (is barely discolored) since the photocatalytic activity stimulated by ultraviolet rays of the rutile type titanium oxide is lower than that of the anatase type titanium oxide. However, when the rutile type titanium oxide is used as a colorant, the deterioration of the binder resin continues due to ultraviolet rays, so image storability deteriorates in some cases. On the other hand, the anatase type titanium oxide is poor in lightfastness (is easily discolored) since the photocatalytic activity stimulated by ultraviolet rays of the anatase type titanium oxide is higher than that of the rutile type titanium oxide. However, when the anatase type titanium oxide is used as a colorant, a polymerization reaction of residual monomers or double bonds of the binder resin is caused by the photocatalytic action stimulated by the ultraviolet rays, so the deterioration of the binder resin is prevented. Therefore, it is possible to suppress the deterioration of the image storability. Using the rutile type titanium oxide in combination with the anatase type titanium oxide as a colorant allows the possibility for obtaining a toner with ability to suppress the deterioration of the image storability resulting from discoloration.

The toner of the exemplary embodiment contains a colorant, a binder resin, and optionally other components such as a release agent. Hereinafter, each component configuring the toner of the exemplary embodiment will be described.

(Binder Resin)

The toner of the exemplary embodiment includes a binder resin. Types of the binder resin are not particularly limited, and a well known crystalline resin and amorphous resin may be used. The crystalline resin and amorphous resin may be used in combination.

—Crystalline Resin—

Examples of the crystalline resin include a crystalline polyester resin, a polyalkylene resin, a long chain alkyl(meth) acrylate resin, and the like. However, it is desirable to use the crystalline polyester resin from the viewpoint that this resin markedly expresses drastic viscosity change caused by heating and that the mechanical strength and low temperature fixability become compatible.

The low temperature fixing in the exemplary embodiment refers to a case of fixing the toner by heating the toner at about 120° C. or lower.

The "crystalline" in the crystalline resin refers to a case where the resin does not show stepwise change in endothermic amount but has a clear endothermic peak in differential scanning calorimetry (DSC). Specifically, the "crystalline" refers to a case where a half width of the endothermic peak is within 10 (° C.) when the resin is measured at a temperature increase rate of 10 (° C./m). On the other hand, a resin showing a half width exceeding 10° C. or a resin not showing a clear endothermic peak indicates that the resin is an amorphous resin (amorphous polymer).

In order to form a crystalline structure easily, a polymerizable monomer including linear aliphatic components is more desirable as a polymerizable monomer component configuring the crystalline resin, compared to a polymerizable monomer including aromatic components. Moreover, in order not to damage crystallinity, components derived from polymerizable monomers configuring the resin are desirably 30 mol % or more respectively as a single kind in the polymer. Particularly, when 2 or more kinds of polymerizable monomers indispensably configure a polyester resin or the like, it is desirable that each kind of the indispensable constituent polymerizable monomers have the above configuration.

Hereinafter, the description focusing on the crystalline polyester resin as a representative crystalline resin will be made.

The melting temperature of the crystalline polyester resin used in the exemplary embodiment is desirably in a range of from 50° C. to 100° C., more desirably in a range of from 55° C. to 90° C., and still more desirably in a range of from 60° C. to 85° C., in respect of the storability and low temperature fixability. If the melting temperature is higher than 50° C., there is no problem of toner storability such as occurrence of blocking in a stored toner and a problem of storability of the fixed image after fixing. If the melting temperature is 100° C. or lower, it is possible to obtain a sufficient low temperature fixability.

The melting temperature of the crystalline polyester resin is determined as a peak temperature of the endothermic peak obtained by differential scanning calorimetry (DSC).

The "crystalline polyester resin" in the exemplary embodiment refers not only to a polymer including a 100% polyester structure as the constituent component, but to a polymer (copolymer) obtained by the copolymerization of the components configuring polyester and other components. Here, in the latter one, the constituent components other than the polyester configuring the polymer (copolymer) are 50% by mass or less.

The crystalline polyester resin used for the toner particles of the exemplary embodiment is synthesized from, for example, polyvalent carboxylic acid components and polyol components. In the exemplary embodiment, commercially available products and synthetic resins may be used as the crystalline polyester resin.

Examples of the polyvalent carboxylic acid components include, but are not limited to, aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids such as dibasic acids including phthalic acid, isophthalic acid, terephthalic acid, naphthalene-2,6-dicarboxylic acid, malonic acid, and mesaconic acid; and anhydrides and lower alkyl esters of these acids.

Examples of the carboxylic acid having a valence of 3 or higher include specific aromatic carboxylic acids such as 1,2,3-benzenetricarboxylic acid, 1,2,4-benzenetricarboxylic acid, and 1,2,4-naphthalenetricarboxylic acid; and anhydrides and lower alkyl esters of these acids. These may be used alone or in combination of two or more kinds thereof.

As the acid component, in addition to the aliphatic dicarboxylic acid and aromatic dicarboxylic acid, a dicarboxylic acid component having sulfonic acid groups may be included.

As the polyol component, an aliphatic diol is desirable, and a linear aliphatic diol having 7 to 20 carbon atoms in the principal chain portion is more desirable. If the aliphatic diol is linear, the crystallinity of the polyester resin is improved, and the melting temperature rises in some cases. If there are 7 or more carbon atoms in the principal chain portion, the low temperature fixing becomes easier since the melting temperature drops when the aliphatic dial is subjected to condensation polymerization with the aromatic dicarboxylic acid. On the other hand, if there are 20 or less carbon atoms in the principal chain portion, materials for practical use are easily obtained. It is more desirable that there are 14 or less carbon atoms in the principal chain portion.

Specific examples of the aliphatic dial which is suitably used for synthesizing crystalline polyester used for the toner particles of the exemplary embodiment include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosane decanediol. Among these, 1,8-octanediol, 1,9-nonanediol, and 1,10-decanediol are desirable in respect that these are easily obtained.

Examples of the polyol having a valence of 3 or higher include glycerin, trimethylolethane, trimethylolpropane, and pentaerythritol. These may be used alone or in combination of two or more kinds thereof.

Among the polyol components, the amount of the aliphatic diol is desirably 80 mol % or more, more desirably 90 mol % or more. If the amount of the aliphatic diol is 80 mol % or more, the crystallinity of the polyester resin is improved, and the melting temperature rises. Therefore, toner blocking resistance and image storability are improved.

For the purpose of optionally adjusting acid value and hydroxyl value, the polyvalent carboxylic acid and polyol may be added at the final stage of the synthesis. Examples of the polyvalent carboxylic acid include aromatic carboxylic acids such as terephthalic acid, isophthalic acid, phthalic anhydride, trimellitic anhydride, pyromellitic anhydride, and naphthalene dicarboxylic acid; aliphatic carboxylic acids such as maleic anhydride, fumaric acid, succinic acid, alkenyl succinic anhydride, and adipic acid; alicyclic carboxylic acids such as cyclohexanedicarboxylic acid; and aromatic carboxylic acids having at least 3 carboxyl groups in one molecule, such as 1,2,4-benzenetricarboxylic acid, 1,2,5-benzenetricarboxylic acid, and 1,2,4-naphthalenetricarboxylic acid.

Examples of the polyol include aliphatic diols such as ethylene glycol, diethylene glycol, triethylene glycol, propylene glycol, butanediol, hexanediol, neopentyl glycol, and glycerin; alicyclic diols such as cyclohexanediol, cyclohexanedimethanol, and hydrogenated bisphenol A; and aromatic diols such as an ethylene oxide adduct of bisphenol A, and propylene oxide adduct of bisphenol A.

It is possible to prepare the crystalline polyester resin at a polymerization temperature of from 180° C. to 230° C. During the preparation, pressure in the reaction system is reduced optionally, and the reaction is caused while water and alcohol generated in condensation are removed.

When the polymerizable monomers are not dissolved or are incompatible at the reaction temperature, a solvent having a high boiling point may be added as a solubilizing agent to dissolve the monomers. The polycondensation reaction is performed while the solubilizing agent is distilled away. When there are polymerizable monomers having poor compatibility in the copolymerization reaction, the polymerizable monomers having poor compatibility and acids or alcohols supposed to be polycondensed with the polymerizable monomers may be condensed in advance, and then the resultant may be polycondensed with principal components.

The acid value (the number of mg of KOH necessary for neutralizing 1 g of a resin) of the crystalline polyester resin used for the exemplary embodiment is desirably in a range of from 3.0 mg KOH/g to 30.0 mg KOH/g, more desirably from 6.0 mg KOH/g to 25.0 mg KOH/g, and still more desirably from 8.0 mg KOH/g to 20.0 mg KOH/g. In the exemplary embodiment, the acid value is measured based on JIS K-0070-1992.

If the acid value is higher than 3.0 mg KOH/g, dispersibility in water is improved, which makes it easier to prepare emulsified particles by a wet process. In addition, since the stability of the emulsified particles in aggregation is improved, a toner is efficiently and easily prepared. On the other hand, if the acid value is 30.0 mg KOH/g or less, hygroscopicity of the toner is not increased, and the toner is barely affected by the environment.

The weight average molecular weight (Mw) of the crystalline polyester resin is desirably from 6,000 to 35,000. If the molecular weight (Mw) is 6,000 or more, a case does not occur where fixing unevenness is caused since the toner penetrates into the surface of a recording medium such as paper during fixing, and the strength against the crease resistance of the fixed image decreases. In addition, if the weight average molecular weight (Mw) is 35,000 or less, the temperature for allowing the resin to reach a suitable viscosity for fixing does not rise since the viscosity during melting does not rise too high, and as a result, the low temperature fixability is obtained.

The weight average molecular weight is measured by Gel Permeation Chromatography (GPC). In the molecular weight measurement performed by GPC, HLC-8120 as a GPC manufactured by TOSOH CORPORATION is used as a measurement device, TSKgel SuperHM-M (15 cm) as a column manufactured by TOSOH CORPORATION is used, and THF is used as a solvent. The weight average molecular weight is calculated using a molecular weight calibration curve created by a standard sample of monodisperse polystyrene from the measured results.

The amount of the crystalline resin in the toner particles is desirably in a range of from 3% by mass to 40% by mass, more desirably in a range of from 4% by mass to 35% by mass, and still more desirably in a range of from 5% by mass to 30% by mass.

It is desirable that the crystalline resin including the crystalline polyester resin include the crystalline polyester resin (hereinafter, referred to as a "crystalline aliphatic polyester resin" in some cases) synthesized using aliphatic polymerizable monomers as a principal component (50% by mass or more). In this case, the constituent ratio of the aliphatic polymerizable monomers configuring the crystalline aliphatic polyester resin is desirably 60 mol % or more, and more desirably 90 mold or more. As the aliphatic polymerizable monomers, the aliphatic diols and dicarboxylic acids are suitably used.

—Amorphous Resin—

As the amorphous resin in the exemplary embodiment, well known resin materials may be used such as a styrene/acrylic resin, an epoxy resin, a polyester resin, a polyurethane resin, a polyamide resin, a cellulose resin, a polyether resin, and a polyolefin resin; however, an amorphous polyester resin is particularly desirable.

Using the amorphous polyester resin improves the compatibility with the crystalline polyester resin. Therefore, as the viscosity at the melting temperature of the crystalline polyester resin is lowered, the viscosity of the amorphous polyester resin is also lowered, so a sharp melting property (sensitive melting property) of the toner is obtained, which is favorable for the low temperature fixability. Moreover, since the wettability between the amorphous and crystalline polyester resins is excellent, the dispersibility of the crystalline polyester resin in the toner is improved, so the crystalline polyester resin is suppressed from being exposed to the toner surface, and as a result, negative effects on chargeability are suppressed. For this reason, the use of the amorphous polyester resin is also desirable in respect of the improvement of the toner strength and fixed image strength.

Hereinafter, the description focusing on the amorphous polyester resin as a representative amorphous resin in the exemplary embodiment will be made.

The amorphous polyester resin which is desirably used in the exemplary embodiment is obtained by, for example, the condensation polymerization between the polyvalent carboxylic acids and the polyols.

Examples of the polyvalent carboxylic acid include aromatic carboxylic acids such as terephthalic acid, isophthalic acid, phthalic anhydride, trimellitic anhydride, pyromellitic acid, and naphthalene dicarboxylic acid; aliphatic carboxylic acids such as maleic anhydride, fumaric acid, succinic acid, alkenyl succinic anhydride, and adipic acid; and alicyclic carboxylic acids such as cyclohexanedicarboxylic acid, and 1 or 2 or more kinds of these polyvalent carboxylic acids may be used. Among these polyvalent carboxylic acids, it is desirable to use the aromatic carboxylic acid. In addition, it is desirable that the polyvalent carboxylic acid have a cross-linked structure or a branched structure to secure an excellent fixing property, and to achieve this, it is desirable to use the dicarboxylic acid and the carboxylic acid (trimellitic acid and an acid anhydride thereof) having a valence of 3 or higher in combination.

Examples of the polyol in the amorphous polyester resin include aliphatic diols such as ethylene glycol, diethylene glycol, triethylene glycol, propylene glycol, butanediol, hexanediol, neopentyl glycol, and glycerin; alicyclic dials such as cyclohexanediol, cyclohexanedimethanol, and hydrogenated bisphenol A; and aromatic dials such as an ethylene oxide adduct of bisphenol A, and a propylene oxide adduct of bisphenol A. One or 2 or more kinds of these polyols may be used. Among these polyols, the aromatic diols and alicyclic diols are desirable, and the aromatic diols are more desirable. In addition, it is desirable that the polyol have a cross-linked structure or a branched structure to secure a more excellent fixing property, and to achieve this, it is desirable to use the diol and the polyol (glycerin, trimethylolpropane, and pentaerythritol) having a valence of 3 or higher in combination.

In the exemplary embodiment, it is desirable that the amorphous polyester resin include alkenyl succinic acid or an anhydride thereof as the constituent component. Using the amorphous polyester resin including the alkenyl succinic acid or an anhydride thereof as the constituent component improves the compatibility between the crystalline and amorphous polyester resins, and makes it possible to obtain excellent low temperature fixability. As the alkenyl succinic acid, dodecenyl succinic acid, octyl succinic acid, and the like are used.

The glass transition temperature (Tg) of the amorphous polyester resin is desirably in a range of from 50° C. to 80° C. If the Tg is 50° C. or higher, the storability of the toner and the fixed image is improved. If the Tg is 80° C. or lower, it is possible to perform fixing at a lower temperature compared to a case in the related art.

The Tg of the amorphous polyester resin is more desirably from 50° C. to 65° C.

The glass transition temperature of the amorphous polyester resin is measured as a peak temperature of the endothermic peak obtained by differential scanning calorimetry (DSC).

The amount of the amorphous resin in the toner particles is desirably in a range of from 40% by mass to 95% by mass, and more preferably in a range of from 50% by mass to 90% by mass, and still more preferably in a range of from 60% by mass to 85% by mass.

The amorphous polyester resin may be prepared based on the case of the crystalline polyester resin.

So far, the crystalline resin and amorphous resin in the exemplary embodiment have been described using crystalline polyester resin and amorphous polyester resin; however, the contents other than the preparation of the polyester resin may be applied to other crystalline resin and amorphous resin in the exemplary embodiment.

The weight average molecular weight (Mw) of the amorphous polyester resin is desirably 30,000 to 80,000. If the molecular weight (Mw) is 30,000 to 80,000, the toner shape is controlled, so the shape is made into a potato shape. In addition, resistance to high temperature offset is obtained.

The weight average molecular weight (Mw) of the amorphous polyester resin is more desirably 35,000 to 80,000, and particularly desirably 40,000 to 80,000.

In the exemplary embodiment, it is desirable to use the amorphous and crystalline polyester resins in combination as a binder resin.

(Colorant)

The toner of the exemplary embodiment includes a colorant. As the colorant, rutile type and anatase type titanium oxides are used in combination.

The ratio between the rutile type and anatase type titanium oxides is desirably 90:10 to 50:50, and more desirably 80:20 to 60:40. If the ratio between the rutile type and anatase type titanium oxides is 90:10 to 50:50, the deterioration of image storability caused by discoloration is further suppressed.

The volume average particle size of the titanium oxide used in the exemplary embodiment is desirably from 100 nm to 400 nm (or from about 100 nm to about 400 nm), and more desirably from 200 nm to 300 nm (or from about 200 nm to about 300 nm). In the exemplary embodiment, the volume average particle size of the titanium oxide refers to a value obtained by the following method.

First, from the particle size range (channel) in which the particle size distribution of the toner measured using a particle size analyzer such as Microtrac (manufactured by NIKKISO CO., LTD.) or the like is divided, the cumulative distribution of the volume of each of the toner particles is determined starting from the small size particles, whereby the particle size reaching cumulative 50% is defined as a volume average particle size $D_{50v}$.

In the exemplary embodiment, surface-treated titanium oxides may be used. Examples of the surface-treated titanium oxides include the ones in which hydrous oxides such as $Al_2O_3$, $SiO_2$, and $ZrO_2$ have been surface-treated, and the ones in which a small amount of different types of metals such as Al and Zn have been doped on the titanium oxide crystal lattice. The surface-treated titanium oxides may be further treated with coupling agents and the like. Examples of surface treatment agents include, but are not limited to, silane coupling agents and the like. The surface treatment agents may be used alone or in combination of 2 or more kinds thereof. The surface treatment is performed by dipping the titanium oxide in the surface treatment agent, for example.

Examples of the silane coupling agents include chlorosilanes, alkoxysilanes, silazanes, and a special silylation agent. Specific examples of the silane coupling agent include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltriethoxysilane, decyltrimethoxysilane, hexamethyldisilazane, N,O-(bistrimethylsilyl)acetamide, N,N-(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane.

The amount of the colorant in the toner of the exemplary embodiment is desirably from 30% by mass to 60% by mass (or from about 30% by mass to about 60% by mass), and more desirably from 40% by mass to 50% by mass, based on the total mass of the toner. If the amount of the colorant is 30% by mass to 60% by mass, the deterioration of the image storability caused by discoloration is further suppressed.

In the exemplary embodiment, colorants other than the rutile type and anatase type titanium oxides may be used in combination. Examples of the other colorants include antimony white, zinc sulfate, silicon oxide, hollow polymers, and hollow silica. Herein, in the exemplary embodiment, the proportion of the total amount of the rutile type and anatase type titanium oxides in the total amount of colorants is from 80% by mass to 100% by mass.

In the exemplary embodiment, as a method of confirming whether the rutile type and anatase type titanium oxides are included in the toner, there is a method of using a Raman spectroscopic instrument.

(Release Agent)

The toner of the exemplary embodiment may include a release agent. Examples of the release agent include paraffin wax such as low molecular weight polypropylene and low molecular weight polyethylene; a silicone resin; rosins; rice wax; and carnauba wax. The melting temperature of these release agents is desirably from 50° C. to 100° C., and more desirably from 60° C. to 95° C. The amount of the release agent in the toner particles is desirably from 0.5% by mass to 15% by mass, and more desirably from 1.0% by mass to 12% by mass. If the amount of the release agent is 0.5% by mass or more, poor-separation does not occur particularly in oilless fixing. If the amount of the release agent is 15% by mass or less, reliability of image quality and image formation, such as improvement of toner fluidity, is improved.

(Other Additives)

The toner of the exemplary embodiment may further include various components such as internal additives, charge control agents, inorganic powder (inorganic particles), and organic particles optionally, in addition to the above components.

Examples of the internal additive include metals such as ferrite, magnetite, reduced iron, cobalt, nickel, and manganese, alloys, and magnetic materials such as compounds including these metals.

Added for various purposes, the inorganic particles may be added for adjusting viscoelasticity of the toner. Through the viscoelasticity adjustment, image glossiness and penetration of the toner into paper are adjusted. As the inorganic particles, well known inorganic particles such as silica particles, alumina particles, cerium oxide particles, or particles obtained by a hydrophobizing treatment of the surface of these particles may be used alone or in combination of two or more kinds thereof. However, it is desirable to use the silica particles having a refractive index lower than that of the binder resin, from the viewpoint that this type of silica particles do not damage color developability and transparency such as OHP transmittance. The silica particles may be subjected to various types of surface treatment, and for example, the silica particles surface-treated with a silane-based coupling agent, a titanium-based coupling agent, and silicone oil are desirably used.

(Characteristics of Toner)

The volume average particle size of the toner in the exemplary embodiment is desirably in a range of from 4 μm to 9 μm, more desirably in a range of from 4.5 μm to 8.5 μm, and still more desirably in a range of from 5 μm to 8 μm. If the volume average particle size is 4 μm or larger, the toner fluidity is improved, and the chargeability of each particle is easily improved. Moreover, since the charge distribution does not widen, it is difficult for the toner to fog a background or to run off the developer unit. If the volume average particle size is 4 μm or larger, a cleaning property does not deteriorate. If the volume average particle size is 9 μm or smaller, resolution is improved. Therefore, sufficient image quality is obtained, so it is possible to satisfy a demand for high image quality in recent years.

The volume average particle size is measured using a Coulter multisizer (manufactured by Beckman Coulter, Inc) at an aperture diameter of 50 μm. At this time, the particle size is measured after the toner is dispersed in aqueous electrolyte solution (aqueous isotonic solution) and further dispersed for at least 30 seconds by ultrasonic waves.

It is desirable that the toner of the exemplary embodiment have a spherical shape showing a shape coefficient SF1 in a range of from 110 to 140. If the shape is spherical in this range, transfer efficiency and denseness of the image are improved, so a high quality image is formed.

It is more desirable that the shape coefficient SF1 be in a range of from 110 to 130.

The shape coefficient SF1 herein is determined by the following formula (1)

$$SF1=(ML^2/A)\times(\pi/4)\times 100 \qquad \text{Formula (1)}$$

In the formula (1), ML represents an absolute maximum length of the toner, and A represents a projection area of the toner, respectively.

Generally, the SF1 is digitalized by the analysis of a microscopic image or a scanning electron microscopic (SEM) image through an image analyzer, and is calculated in the following manner, for example. That is, an optical microscopic image of particles dispersed on the surface of a slide glass is provided to a Luzex image analyzer though a video camera, the maximum length and projection area of 100 particles are determined to calculate SF1 through the formula (1), and the average thereof is determined to obtain SF1.

<Method for Preparing Toner>

The toner of the exemplary embodiment may be prepared by adding external additives to the toner particles after the toner particles are prepared.

A method for preparing the toner particles is not particularly limited. The toner particles are prepared by well known dry methods such as kneading and pulverizing processes, and wet methods such as emulsion aggregation and suspension polymerization.

In the kneading and pulverizing process, after each of the materials including the binder resin is mixed, the materials are subjected to melt-kneading by using a kneader, extruder, or the like, and then the obtained resultant of the melt-kneading is roughly ground. Thereafter, the resultant is ground by a jet mill or the like, whereby toner particles having a target size are obtained by an air classifier.

In the above methods, it is desirable to use the emulsion aggregation in which the shape of the toner particles and the toner particle size are easily controlled, and a control range of the toner particle structure such as a core shell structure is wide. Hereinafter, a method of preparing the toner particles by the emulsion aggregation will be described in detail.

The emulsion aggregation in the exemplary embodiment includes emulsification for forming resin particles (emulsified particles) or the like by emulsifying raw materials configuring the toner particles, aggregation for forming aggregates of the resin particles or the like, and coalescence for coalescing the aggregates.

(Emulsification)

A resin particle dispersion may be prepared by general polymerization including emulsion polymerization, suspension polymerization, and dispersion polymerization; also, the resin particle dispersion may be emulsified by applying shearing force to a solution in which an aqueous medium and a binder resin are mixed by using a dispersing machine. At this time, the particles may be formed by lowering the viscosity of the resin component through heating. In addition, in order to stabilize the dispersed resin particles, a dispersant may be used. If the resin is oily and dissolved in a solvent which shows relatively low solubility in water, the resin is dissolved in the solvent and is subjected to particle dispersion in water together with a dispersant and polymer electrolytes, and then the solvent is evaporated by heating or pressure reduction, whereby the resin particle dispersion is prepared.

Examples of the aqueous medium include water such as distilled water, and ion-exchange water; and alcohols, but it is desirable to use water only.

Examples of the dispersant used in the emulsification include water-soluble polymers such as polyvinyl alcohol, methylcellulose, ethylcellulose, hydroxyethyl cellulose, carboxymethyl cellulose, sodium polyacrylate, and sodium polymethacrylate; surfactants including anionic surfactants such as sodium dodecylbenzenesulfonate, sodium octadecylsulfate, sodium oleate, sodium laurate, and potassium stearate; cationic surfactants such as laurylamine acetate, stearylamine acetate, and lauryltrimethylammonium chloride; zwitterionic surfactants such as lauryldimethylamine oxide; and nonionic surfactants such as polyoxyethylene alkyl ether, polyoxyethylene alkylphenyl ether, and polyoxyethylene alkylamine; inorganic salts such as tricalcium phosphate, aluminum hydroxide, calcium sulfate, calcium carbonate, and barium carbonate.

Examples of the dispersing machine used for preparing the emulsified liquid include a homogenizer, a homo mixer, a pressurize kneader, an extruder, and a media dispersing machine. As the resin particle size, the average particle size (volume average particle size) is desirably 1.0 μm or smaller, more desirably in a range of from 60 nm to 300 nm, and still more desirably in a range of from 150 nm to 250 nm. If the size is 60 nm or larger, the resin particles are prone to be unstable in the dispersion, so the resin particles are easily aggregated in some cases. If the size is 1.0 μm or smaller, the particle size distribution of the toner becomes narrow in some cases.

In preparing a release agent dispersion, the release agent is dispersed in water together with the polymer electrolytes such as the ionic surfactant, a polymeric acid, and a polymeric base, and then the resultant is heated at a temperature equal to or higher than the melting temperature of the release agent and is dispersed by a homogenizer or a pressure discharging type of dispersing machine, which impart a strong shearing force. Through this process, the release agent dispersion is obtained. During dispersing, an inorganic compound such as polyaluminum chloride may be added to the dispersion. Examples of the desirable inorganic compound include polyaluminum chloride, aluminum sulfate, high basicity polyaluminum chloride (BAC), polyaluminum hydroxide, and aluminum chloride. Among these, polyaluminum chloride, aluminum sulfate, and the like are desirable. The release agent dispersion is used for the emulsion aggregation, but may also be used in preparing the toner by the suspension polymerization.

The release agent dispersion including release agent particles having a volume average particle size of 1 μm or smaller is obtained through dispersing. The volume average particle size of the release agent particles is more desirably from 100 nm to 500 nm.

If the volume average particle size is 100 nm or larger, the characteristic of the binder resin to be used is affected, but the release agent component is easily incorporated into the toner in general. If the volume average particle size is 500 nm or smaller, the release agent is sufficiently dispersed in the toner.

It is possible to use well known dispersing methods for preparing a colorant dispersion. For example, it is possible to use general dispersing devices such as a rotation shear type homogenizer, a ball mill including media, a sand mill, a dyno mill, and an ultimaizer, but there is no limitation to the devices. The colorant is dispersed in water together with the polymer electrolytes such as the ionic surfactant, a polymeric acid, and a polymeric base. The volume average particle size of the dispersed colorant particles may be 1 μm or smaller. If the volume average particle size is in a range of from 80 nm to 500 nm, aggregation property is not damaged, and the colorant is excellently dispersed in the toner, which is thus desirable.

(Aggregation)

In the aggregation, the resin particle dispersion, the colorant dispersion, and the release agent dispersion are mixed to obtain a mixed solution, the mixed solution is aggregated by being heated at a temperature equal to or lower than the glass transition temperature of the resin particles, thereby forming aggregated particles. In many cases, the aggregated particles are formed by adjusting the pH of the mixed solution to be acidic under stirring. It is desirable that the pH is in a range of from 2 to 7, and at this time, the use of an aggregating agent is also effective.

In the aggregation, the release agent dispersion may be added to and mixed with various dispersions such as the resin particle dispersion at once, or may be added in divided plural portions.

As the aggregating agent, in addition to the surfactants with polarity opposite to the polarity of the surfactants used for the dispersant and the inorganic metal salts, a metal complex having a valence of 2 or higher is suitably used. Particularly, if the metal complex is used, it is possible to reduce the amount of the surfactant used, whereby charging characteristics are improved. Therefore, the use of the metal complex is particularly desirable.

As the inorganic metal salts, an aluminum salt and a polymer thereof are particularly suitable. In order to obtain a narrower particle size distribution, a divalent inorganic metal salt is more suitable than a monovalent inorganic metal salt, a trivalent inorganic metal salt is more suitable than a divalent inorganic metal salt, and a quadrivalent inorganic metal salt is more suitable than a trivalent inorganic metal salt. In addition, a polymerization type inorganic metal salt polymer is more suitable among the ones having the same valence.

In the exemplary embodiment, in order to obtain a narrow particle size distribution, it is desirable to use the polymer of the quadrivalent inorganic metal salt including aluminum.

A toner having a configuration in which the surface of core aggregated particles is coated with a resin may be prepared by further adding the resin particle dispersion at a point of time when the aggregated particles reach a desired particle size (coating). In this case, it is difficult for the release agent and the colorant to be exposed on the toner surface. Therefore, this configuration is desirable from the viewpoint of the chargeability and the developability. When the resin particle dispersion is further added, the aggregating agent may be added before the resin particle dispersion, or the pH may be adjusted.

(Coalescence)

In coalescence, the pH of a suspension of the aggregated particles is raised to a range of from 3 to 9 under a stirring condition based on the aggregation, whereby the aggregation stops proceeding, and heating is performed at a temperature equal to or higher than the glass transition temperature of the resin. In this manner, the aggregated particles are coalesced. When the aggregated particles are coated with the resin, the resin is also coalesced and coats the core aggregated particles. The heating may be performed for about a time long enough to cause the coalescence, which may be about 0.5 hours to 10 hours.

Cooling is performed after coalescence, whereby coalesced particles are obtained. By decreasing a cooling rate near the glass transition temperature of the resin (in a range of the glass transition temperature±10° C.), that is, by a so-called slow cooling, crystallization may be promoted.

The coalesced particles obtained by coalescence are made into toner particles through solid-liquid separation such as filtration, and cleaning as well as optionally drying.

For the purpose of charge adjustment, imparting fluidity and an electric charge exchange property, and the like, inorganic oxides represented by silica, titania, and aluminum oxide are additionally attached to the obtained toner particles as the external additive. It is possible to attach these additives by using, for example, a V-shaped blender, a Henschel mixer, and a Lödige mixer; also, they may be attached in divided stages. The amount of the external additive to be added is desirably in a range of from 0.1 part by mass to 5 parts by mass, and more desirably in a range of from 0.3 part by mass to 2 parts by mass, based on 100 parts by mass of the toner particles.

Moreover, optionally, by using an ultrasonic sieving machine, a vibration sieving machine, an air classifier machine, and the like, coarse particles of the toner may be removed after the addition of the external additive.

In addition to the external additives described above, other components (particles) such as a charge control agent, organic particles, a lubricant, and an abrasive may be added.

As the charge control agent, it is desirable to use a colorless one or a light-colored one, but there is no particular limitation. Examples of the charge control agent include a complex of such as a quaternary ammonium salt compound, a nigrosine-based compound, aluminum, iron, chromium; and a triphenylmethane-based pigment.

Examples of the organic particles include particles generally used as the external additives for the toner surface, such as a vinyl-based resin, a polyester resin, and a silicone resin. These inorganic or organic particles are used as a fluidity aid, and a cleaning aid, for example.

Examples of the lubricant include fatty acid amides such as ethylene bis-stearic acid amide and oleic acid amide; and fatty acid metal salts such as zinc stearate and calcium stearate.

Examples of the abrasive include silica, alumina, and cerium oxide described above.

<Electrostatic Charge Image Developer>

The electrostatic charge image developer (hereinafter, simply referred to as developer in some cases) of the exemplary embodiment includes at least the toner of the exemplary embodiment.

The toner of the exemplary embodiment is used as a single-component developer as it is or as a two-component developer. When being used as the two-component developer, the toner is used by being mixed to a carrier.

As the carrier that may be used for the two-component developer, well known carriers are used without any limitation. Examples of the carrier include magnetic metals such as an iron, nickel, and cobalt; magnetic oxides such as ferrite, and magnetite; resin-coated carriers including a resin-coated layer on the surface of the core thereof; and magnetic dispersed type carriers. In addition, the carrier may be a resin dispersed type carrier in which a conductive material or the like is dispersed in a matrix resin.

Examples of the coating resin and matrix resin used for the carrier include, but are not limited to, polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid copolymer, a straight silicone resin configured with an organosiloxane bond and a modified product thereof, fluorine resin, polyester, polycarbonate, a phenol resin, and an epoxy resin.

Examples of the conductive material include, but are not limited to, metals such as gold, silver, copper, carbon black, titanium oxide, zinc oxide, barium sulfate, aluminum borate, potassium titanate, and tin oxide.

Examples of the core of the carrier include magnetic metals such as iron, nickel, and cobalt; magnetic oxides such as ferrite and magnetite; and glass beads. However, in order to use the carrier for a magnetic brush method, it is desirable to use magnetic materials. The volume average particle size of the carrier core is generally in a range of from 10 to 500 μm, and desirably in a range of from 30 μm to 100 μm.

Examples of a method of coating a resin on the surface of the carrier core include a method in which coating is performed using a solution for forming a coated layer obtained by dissolving the coating resin and various additives optionally in a proper solvent. The solvent is not particularly limited, and may be selected in consideration of the coating resin to be used and coating suitability.

Specific examples of the resin coating method include a dipping method of dipping the carrier core into the solution for forming a coated layer, a spray method of spraying the solution for forming a coated layer to the carrier core surface, a fluidized-bed method of spraying the solution for forming a coated layer while the carrier core is floated by fluidizing air, and a kneader coater method of mixing the carrier core with the solution for forming a coated layer in a kneader coater and removing the solvent.

The mixing ratio (mass ratio) between the toner and the carrier of the exemplary embodiment in the two-component developer is desirably in a range of from toner:carrier=about 1:100 to 30:100, and more desirably in a range of from about 3:100 to 20:100.

<Toner Cartridge, Process Cartridge, and Image Forming Apparatus>

The image forming apparatus of the exemplary embodiment includes a latent image holding member, a charging unit charging the surface of the latent image holding member, an electrostatic charge image forming unit forming an electrostatic charge image on the surface of the latent image holding member, a developing unit developing the electrostatic charge image by using a developer of the exemplary embodiment and forming a toner image, a transfer unit transferring the toner image to a recording medium, and a fixing unit fixing the toner image to the recording medium.

The image forming apparatus of the exemplary embodiment may be an image forming apparatus in which each toner image held on the latent image holding member is sequentially and primarily transferred to an intermediate transfer member repeatedly, or may be a tandem type image forming apparatus in which plural latent image holding members including developing units for each color are arranged in tandem on the intermediate transfer member, for example.

The image forming apparatus of the exemplary embodiment may have a cartridge structure (a process cartridge) in which a portion including the developing unit containing the developer of the exemplary embodiment is detachable from the image forming apparatus, or a cartridge structure (a toner cartridge) in which a portion containing the toner of the exemplary embodiment as a replenishing toner supplied to the developing unit is detachable from the image forming apparatus, for example.

By the image forming apparatus of the exemplary embodiment, the image forming method of the exemplary embodiment is performed which includes charging the surface of a latent image holding member, forming an electrostatic charge image on the surface of the latent image holding member, developing an electrostatic charge image by using the developer of the exemplary embodiment to form a toner image, transferring the toner image to a recording medium, and fixing the toner image to the recording medium.

Hereinafter, the image forming apparatus of the exemplary embodiment will be described with reference to the drawing.

FIG. 1 is a schematic configurational view illustrating an example of an image forming apparatus of the exemplary embodiment. The image forming apparatus of the exemplary embodiment relates to a tandem type configuration in which plural photoreceptors as the latent image holding member, that is, plural image forming units are provided.

As shown in FIG. 1, in the image forming apparatus of the exemplary embodiment, four image forming units 50Y, 50M, 50C, and 50K for respectively forming toner images of each color of yellow, magenta, cyan, and black, and an image forming unit 50W for forming a white toner image are arranged in parallel (in tandem) at intervals. The respective image forming units are arranged in an order of the image forming units 50Y, 50M, 50C, 50K, and 50W, from the upstream side in the rotation direction of an intermediate transfer belt 33.

Herein, each of the image forming units 50Y, 50M, 50C, 50K, and 50W has the same configuration except that the developer accommodated in the units are different in the toner color. Therefore, herein, the image forming unit 50Y forming a yellow image will be representatively described. In addition, the same portions as that of the image forming unit 50Y are marked with reference numerals indicating magenta (M), cyan (C), black (K), and white (W), instead of yellow (Y), whereby the description for each of the image forming units 50M, 50C, 50K, and 50W will be omitted.

The yellow image forming unit 50Y includes a photoreceptor 11Y as the latent image holding member. The photoreceptor 11Y is driven by a driving unit (not shown) so as to rotate at a preset process speed in an arrow A direction shown in the drawing. As the photoreceptor 11Y, for example, an organic photoreceptor having sensitivity to an infrared region is used.

In the upper portion of the photoreceptor 11Y, a charging roll (charging unit) 18Y is provided. A preset voltage is applied to the charging roll 18Y by a power supply (not shown), whereby the surface of the photoreceptor 11Y is charged with a preset potential.

Around the photoreceptor 11Y, an exposure device (electrostatic charge image forming unit) 19Y forming an electrostatic charge image by exposing the surface of the photoreceptor 11Y is arranged at the downstream side from the charging roll 18Y in the rotation direction of the photoreceptor 11Y. Herein, as the exposure device 19Y, an LED array realizing miniaturization is used in consideration of the space. However, the exposure device 19Y is not limited thereto, and needless to say, there is no problem with using other electrostatic charge image forming units using laser beams or the like.

Around the photoreceptor 11Y, a developing device (developing unit) 20Y including a developer holder holding a yellow developer is arranged at the downstream side from the exposure device 19Y in the rotation direction of the photoreceptor 11Y. The developing device 20Y has a configuration of making a toner image on the surface of the photoreceptor 11Y by making the electrostatic charge image formed on the surface of the photoreceptor 11Y into a visible image by using the yellow toner.

Under the photoreceptor 11Y, an intermediate transfer belt (primary transfer unit) 33 performing a primary transfer of the toner image formed on the surface of the photoreceptor 11Y is arranged such that it passes under the 5 photoreceptors 11Y, 11M, 11C, 11K, and 11W. The intermediate transfer belt 33 is pressed on the surface of the photoreceptor 11Y by a primary transfer roll 17Y. The intermediate transfer belt 33 is hung by tension by 3 rolls including a driving roll 12, a supporting roll 13, and a bias roll 14, and circulates in the arrow B direction at a movement speed equivalent to the process speed of the photoreceptor 11Y. The yellow toner image is primarily transferred to the surface of the intermediate transfer belt 33, and the toner images of each color including magenta, cyan, black, and white are sequentially and primarily transferred and stacked.

Around the photoreceptor 11Y, a cleaning device 15Y for cleaning the toner remaining on the surface of the photoreceptor 11Y and the retransferred toner is arranged at the downstream side from the primary transfer roll 17Y in the rotation direction (arrow A direction) of the photoreceptor 11Y. A cleaning blade of the cleaning device 15Y is provided so as to come into pressure-contact with the surface of the photoreceptor 11Y in the counter direction.

A secondary transfer roll (secondary transfer unit) 34 comes into pressure contact with the bias roll 14 which causes the intermediate transfer belt 33 to be hung by tension, through the intermediate transfer belt 33. The toner image primarily transferred to and stacked on the surface of the intermediate transfer belt 33 is electrostatically transferred to the surface of recording paper (recording medium) P supplied from a paper cassette (not shown), in a portion where the bias roll 14 and the secondary transfer roll 34 perform pressure contact. At this time, the white toner image becomes the uppermost one (uppermost layer) in the toner images transferred to and stacked on the intermediate transfer belt 33. Therefore, in the toner images transferred to the surface of the recording paper P, the white toner image becomes the lowest one (lowest layer).

Downstream of the secondary transfer roll 34, a fixing device (fixing unit) 35 is arranged which makes a fixed image by fixing the toner image multi-transferred to the recording paper P on the surface of the recording paper P by heat and pressure.

As the fixing device 35, for example, a fixing belt formed into a belt shape and a fixing roll formed into a cylindrical shape, which use a low surface energy material represented by a fluorine resin and a silicone-based resin on the surface thereof, are used.

Next, the operations of each of the image forming units 50Y, 50M, 50C, 50K, and 50W which forms images of each color including yellow, magenta, cyan, black, and white will be described. The operations of each of the image forming units 50Y, 50M, 50C, 50K, and 50W are the same as each other, so the operation of the yellow image forming unit 50Y will be representatively described.

In the yellow image forming unit 50Y, the photoreceptor 11Y rotates in the arrow A direction at a preset process speed. By the charging roll 18Y, the surface of the photoreceptor 11Y is negatively charged with a preset potential. Thereafter, the surface of the photoreceptor 11Y is exposed by the exposure device 19Y, whereby the electrostatic charge image according to image information is formed. Subsequently, the toner charged negatively by the developing device 20Y is subjected to reversal development, and the electrostatic charge image formed on the surface of the photoreceptor 11Y is made into a visible image on the surface of the photoreceptor 11Y, whereby the toner image is formed. Then, the toner image on the surface of the photoreceptor 11Y is primarily transferred to the surface of the intermediate transfer belt 33 by the primary transfer roll 17Y. After the primary transfer, the photoreceptor 11Y is cleaned since residual transfer components such as toner remaining on the surface of the photoreceptor 11Y is cleaned by the cleaning blade of the cleaning device 15Y, and is ready for the next image formation.

The above operation is performed by each of the image forming units 50Y, 50M, 50C, 50K, and 50W, and the visualized toner images formed on the surface of each of the photoreceptors 11Y, 11M, 11C, 11K, and 11W are multi-transferred to the surface of the intermediate transfer belt 33 one after another. In a color mode, the toner image of each color is multi-transferred in an order of yellow, magenta, cyan, black, and white. However, even in a two-color mode and a three-color mode, only the toner image of a necessary color is transferred alone or multi-transferred in this order. Thereafter, the toner image transferred alone or multi-transferred to the surface of the intermediate transfer belt 33 is secondarily transferred to the surface of the recording paper P supplied from the paper cassette (not shown), by the secondary transfer roll 34. Subsequently, the toner image is fixed by being heated and pressed in the fixing device 35. The toner remaining on the surface of the intermediate transfer belt 33 after the secondary transfer is cleaned by a belt cleaner 16 configured with the cleaning blade for the intermediate transfer belt 33.

The yellow image forming unit 50Y is configured as the process cartridge in which the developing device 20Y including the developer holder holding the yellow developer, the photoreceptor 11Y, the charging roll 18Y, and the cleaning device 15Y are integrally attached to or detached from the main body of the image forming apparatus. The image forming units 50W, 50K, 50C, and 50M are also configured as the process cartridge in the same manner as the image forming unit 50Y.

Toner cartridges 40Y, 40M, 40C, 40K, and 40W contain each color of toner and are attached to and detached from the image forming apparatus. The toner cartridges are connected to developing devices corresponding to respective colors through toner supplying tubes (not shown). When each toner cartridge is running short of the toner stored therein, the toner cartridge is replaced.

EXAMPLES

Hereinafter, the exemplary embodiment will be described in more detail by using examples and comparative examples, but the exemplary embodiment is not limited to the following examples. In addition, a "part" and "%" represents "part by mass" and "% by mass" respectively, unless otherwise specified.

(Crystalline Resin Synthesis)

1,12-dodecanedioic acid: 952 parts 1,9-nonanediol: 656 parts

Fumaric acid: 30 parts

Dibutyltin: 2 parts

Each of the above components is mixed in a flask, followed by heating to 220° C. under a reduced-pressure atmosphere, and the resultant is subjected to a dehydration condensation reaction for 6 hours, thereby obtaining a crystalline polyester resin.

(Amorphous Resin 1 Synthesis)

Ethylene oxide 1-mol adduct of bisphenol A: 25 parts

Ethylene glycol: 25 parts

Terephthalic acid: 30 parts

Succinic acid: 20 parts

The above polyol components and the polyvalent carboxylic acid components are put into a round-bottom flask including a stirrer, a nitrogen introducing tube, a temperature sensor, and a rectifier, and the temperature is raised to 200° C. by using a mantle heater. Subsequently, nitrogen gas is introduced thereto through a gas introducing tube, followed by stirring while the inside of the flask is kept at inert gas atmosphere. Thereafter, 0.05 part of dibutyltin oxide based on 100 parts of the raw material mixture is added thereto, and the resultant is allowed to react for a predetermined time while the temperature of the reactant is kept at 200° C., thereby obtaining an amorphous resin 1.

(Amorphous Resin 2 Synthesis)

Ethylene oxide 1-mol adduct of bisphenol A: 25 parts

Propylene oxide 1-mol adduct of bisphenol A: 25 parts

Terephthalic acid: 30 parts

Succinic acid: 5 parts

Trimellitic anhydride: 15 parts

The above polyol components and the polyvalent carboxylic acid components are put into a round-bottom flask including a stirrer, a nitrogen introducing tube, a temperature sensor, and a rectifier, and the temperature is raised up to 200° C. by using a mantle heater. Subsequently, nitrogen gas is introduced thereto through a gas introducing tube, followed by stirring while the inside of the flask is kept at inert gas atmosphere. Thereafter, 0.05 part of dibutyltin oxide based on 100 parts of the raw material mixture is added thereto, and the resultant is allowed to react while the temperature of the reactant is kept at 200° C., thereby obtaining an amorphous resin 2.

(Preparation of Crystalline Resin Dispersion)

80 parts of a crystalline polyester resin and 720 parts of deionized water are put into a stainless steel beaker and heated at 95° C. in a hot bath. At a point of time when the crystalline polyester resin becomes molten, the resin is stirred by a homogenizer (manufactured by IKA Corporation: ULTRA-TURRAX T50) at 8000 rpm. Subsequently, while 20 parts of a solution obtained by diluting 1.6 parts of an anionic surfactant (manufactured by DAI-ICHI KYOGYO SEIYAKU CO., LTD., Neogen RK) in 18.4 parts of ion exchange water is added dropwise thereto, emulsification and dispersion are performed, whereby a crystalline polyester resin particle dispersion (resin particle concentration: 10%) having a volume average particle size of 0.24 μm is obtained.

(Preparation of Amorphous Resin Particle Dispersion 1)

While in the molten state, the amorphous resin 1 is transferred to an emulsifier (Cabitron CD 1010, manufactured by Eurotec, Ltd) at a rate of 100 g/m. In an aqueous medium tank prepared separately, a 0.40% concentration of diluted aqueous ammonia obtained by diluting reagent grade aqueous ammonia in ion exchange water is introduced, and the diluted aqueous ammonia is transferred to the emulsifier simultaneously with the molten polyester resin at a rate of 0.1 L/m while being heated at 120° C. by a heat exchanger. In this state, the emulsifier is driven under a condition of the rotation rate of a rotor of 60 Hz and pressure of 0.49 MPa (5 kg/cm$^2$), thereby obtaining the amorphous resin particle dispersion 1 (resin particle concentration: 30%) having a volume average particle size of 0.15 μm.

(Preparation of Amorphous Resin Particle Dispersion 2)

While in the molten state, the amorphous resin 2 is transferred to an emulsifier (Cabitron CD 1010, manufactured by Eurotec, Ltd) at a rate of 100 g/m. In an aqueous medium tank prepared separately, a 0.40% concentration of diluted aqueous ammonia obtained by diluting reagent grade aqueous ammonia in ion exchange water is introduced, and the diluted aqueous ammonia is transferred to the emulsifier simultaneously with the molten polyester resin at a rate of 0.1 L/m while being heated at 120° C. by a heat exchanger. In this state, the emulsifier is driven under a condition of the rotation rate of a rotor of 60 Hz and pressure of 0.49 MPa (5 kg/cm$^2$), thereby obtaining an amorphous resin particle dispersion 2 (resin particle concentration: 30%) having a volume average particle size of 0.23 μm.

(Preparation of Rutile Type Titanium Oxide Dispersion)

Rutile type titanium oxide CR-50 (manufactured by ISHIHARA SANGYO KAISHA, LTD.): 200 parts Anionic surfactant (manufactured by DAI-ICHI KYOGYO SEIYAKU CO., LTD., Neogen RK): 5 parts Ion exchange water: 195 parts The above components are dispersed by a homogenizer (manufactured by IKA Corporation: ULTRA-TURRAX T50), whereby a rutile type titanium oxide dispersion (rutile type titanium oxide concentration: 50%) having a volume average particle size of 315 nm is prepared.

(Preparation of Anatase Type Titanium Oxide Dispersion)

Anatase type titanium oxide A-220 (manufactured by ISHIHARA SANGYO KAISHA, LTD.): 200 parts Anionic surfactant (manufactured by DAI-ICHI KYOGYO SEIYAKU CO., LTD., Neogen RK): 5 parts Ion exchange water: 195 parts The above components are dispersed by a homogenizer (manufactured by IKA Corporation: ULTRA-TURRAX T50), whereby an anatase type titanium oxide dispersion (anatase type titanium oxide concentration: 50%) having a volume average particle size of 240 nm is prepared.

(Preparation of Release Agent Dispersion)

Paraffin wax HNP 9 (melting temperature: 74° C., manufactured by NIPPON SEIRO CO., LTD): 45 parts Anionic surfactant (manufactured by DAI-ICHI KYOGYO SEIYAKU CO., LTD., Neogen RK): 5 parts Ion exchange water: 200 parts The above components are heated at 95° C. and dispersed by a homogenizer (manufactured by IKA Corporation: ULTRA-TURRAX T50), followed by dispersion by using a pressure discharging type of Gaulin homogenizer (manufactured by Gaulin. Corporation), whereby a release agent dispersion (release agent concentration: 20%) obtained by dispersing a release agent having a volume average particle size of 215 nm is prepared.

Example 1

Amorphous resin particle dispersion 1: 200 parts
Amorphous resin particle dispersion 2: 200 parts
Crystalline polyester resin particle dispersion: 110 parts
Release agent dispersion: 80 parts
Rutile type titanium oxide dispersion: 180 parts
Anatase type titanium oxide dispersion: 20 parts
Polyaluminum chloride (manufactured by TAIMEI CHEMICALS CO., LTD.): 5 parts The above components are measured and put in a stainless reaction container, and 2% aqueous HCl solution is added thereto. After the pH is adjusted to 4, the resultant is mixed for 5 minutes under 5000 rotations of an ULTRA-TURRAX (manufactured by IKA Corporation) and aggregated while the temperature is raised to 50° C. at a rate of 1° C./m. The particle size is measured using a Coulter counter-TA-II model (manufactured by Beckman Coulter, Inc.), and when the particle size becomes 5.8 μm, 30 g of 4% aqueous NaOH solution is added thereto, followed by heating to 95° C. The resultant is retained as it is for 2 hours, followed by addition of 2% aqueous HCl solution to adjust the pH to 6.5, and then retained as it is for another 1 hour. Thereafter, the resultant is cooled at a rate of 1° C./m to 81° C. which is 6° C. higher than the melting temperature of the crystalline polyester resin, and then further cooled to 30° C. at a rate of 30° C./m, thereby obtaining toner mother particles.

1.5 parts of hydrophobic silica (manufactured by NIPPON AEROSIL CO., RY50) and 1.0 part of hydrophobic titanium oxide (manufactured by NIPPON AEROSIL CO., T805) based on 100 parts of the obtained toner mother particles are blended and mixed for 30 seconds by a sample mill at 10000 rpm. Subsequently, the resultant is sieved by a vibration sieve having 45 μm openings, thereby preparing a toner 1.

<Preparation of Carrier>

Toluene: 14 parts
Styrene-methyl methacrylate copolymer (component ratio: 80/20, weight average molecular weight: 70000): 2 parts
MZ 500 (zinc oxide, manufactured by Titan Kogyo, Ltd.): 0.6 parts The above components are mixed and stirred for 10 minutes by a stirrer, thereby preparing a solution for forming a coated layer in which zinc oxide has been dispersed. Subsequently, this coating solution and 100 parts of ferrite particles (volume average particle size: 38 μm) are put in a vacuum deaeration type kneader so as to be stirred for 30 minutes at 60° C., and the resultant is subjected to deaeration by pressure reduction while being heated, followed by drying, thereby preparing a carrier.

<Preparation of Developer>

The obtained carrier and the toner 1 are mixed at a ratio of 100 parts:8 parts respectively by a 2 L V-blender, thereby preparing a developer 1.

<Evaluation>

Under an environment of a temperature of 22° C. and a humidity of 55% RH, the developer 1 obtained in the above manner is filled in a developer unit of a remodeled apparatus (5-drum tandem type remodeled apparatus for duplex printing) of a 5-drum tandem system of DocuCentre-III C7600 manufactured by Fuji Xerox Co., Ltd. shown in FIG. 1, and a solid image (3 cm×4 cm) is printed on recording paper (JD paper manufactured by Fuji Xerox InterField Co., Ltd.) at a fixing temperature of 160° C. and under a condition of the amount of loaded toner of 4.5 g/m$^2$. The obtained solid image is subjected to the following test, and the obtained evaluation results are shown in Table 1.

—Image Cracking Evaluation—

The obtained solid image is irradiated with ultraviolet rays for 25 minutes by a handy UV light (CT-W1000-I, 365 nm, 240 mW/cm$^2$) manufactured by Coattec, Inc, the image is folded toward its inside, and a roll having a weight of 860 g and a diameter of 76 mm is rolled on the image on a horizontal table at a rate of about 150 mm/s to make a crease. A level in which a maximum width of the missing image in the folded portion is 0.30 mm or less (a scale magnifier, the observation with a 10× magnification) when the image is opened back to its initial state is taken as an unproblematic level.

(Evaluation Criteria)

A: No image cracking, unproblematic level
B: Small image cracking portion, unproblematic level
C: A certain degree of image cracking, unproblematic level
D: Profound image cracking, problematic —Whiteness Evaluation—

The optical density of the obtained solid image is measured by an X-rite densitometer (X-Rite 938, manufactured by X-Rite US, Incorporated), whereby a whiteness W and a whiteness variation ΔW of the image is measured by the following formula. Herein, W0 indicates the whiteness before the ultraviolet irradiation, and W1 indicates the whiteness after the ultraviolet irradiation.

$$\text{Whiteness } W=100-\{(100-L^*)^2+a^{*2}+b^{*2}\}^{0.5}$$

$$\Delta W=W0-W1$$

(Evaluation Criteria)

A: ΔW=0 or greater and less than 1.0
B: ΔW=1.0 or greater and less than 1.5
C: ΔW=1.5 or greater and less than 2.0
D: ΔW=2.0 or greater Example 2

A toner 2 and a developer 2 are prepared in the same manner as in Example 1 except that 140 parts of the rutile type titanium oxide dispersion and 60 parts of the anatase type titanium oxide dispersion are used, and the evaluation is performed in the same manner as in Example 1. The obtained results are shown in Table 1.

Example 3

A toner 3 and a developer 3 are prepared in the same manner as in Example 1 except that 100 parts of the rutile type titanium oxide dispersion and 100 parts of the anatase type titanium oxide dispersion are used, and the evaluation is performed in the same manner as in Example 1. The obtained results are shown in Table 1.

Example 4

A toner 4 and a developer 4 are prepared in the same manner as in Example 1 except that the 190 parts of the rutile type titanium oxide dispersion and 10 parts of the anatase type titanium oxide dispersion are used, and the evaluation is performed in the same manner as in Example 1. The obtained results are shown in Table 1.

Example 5

A toner 5 and a developer 5 are prepared in the same manner as in Example 1 except that the 80 parts of the rutile type titanium oxide dispersion and 120 parts of the anatase type titanium oxide dispersion are used, and the evaluation is performed in the same manner as in Example 1. The obtained results are shown in Table 1.

Example 6

Amorphous resin particle dispersion 1: 90 parts
Amorphous resin particle dispersion 2: 90 parts
Crystalline polyester resin particle dispersion: 50 parts
Release agent dispersion: 80 parts
Rutile type titanium oxide dispersion: 315 parts
Anatase type titanium oxide dispersion: 35 parts
Polyammonium chloride (manufactured by TAIMEI CHEMICALS CO., LTD.): 5 parts A toner 6 and a developer 6 are prepared in the same manner as in Example 1 except that the above components are used, and the evaluation is performed in the same manner as in Example 1. The obtained results are shown in Table 1.

Example 7

A toner 7 and a developer 7 are prepared in the same manner as in Example 6 except that the 245 parts of the rutile type titanium oxide dispersion and 105 parts of the anatase type titanium oxide dispersion are used, and the evaluation is performed in the same manner as in Example 1. The obtained results are shown in Table 1.

Example 8

A toner 8 and a developer 8 are prepared in the same manner as in Example 6 except that the 175 parts of the rutile type titanium oxide dispersion and 175 parts of the anatase type titanium oxide dispersion are used, and the evaluation is performed in the same manner as in Example 1. The obtained results are shown in Table 1.

Example 9

A toner 9 and a developer 9 are prepared in the same manner as in Example 6 except that the 333 parts of the rutile type titanium oxide dispersion and 17 parts of the anatase type titanium oxide dispersion are used, and the evaluation is performed in the same manner as in Example 1. The obtained results are shown in Table 1.

Example 10

A toner 10 and a developer 10 are prepared in the same manner as in Example 6 except that the 140 parts of the rutile type titanium oxide dispersion and 210 parts of the anatase type titanium oxide dispersion are used, and the evaluation is performed in the same manner as in Example 1. The obtained results are shown in Table 1.

Example 11

Amorphous resin particle dispersion 1: 265 parts
Amorphous resin particle dispersion 2: 265 parts
Crystalline polyester resin particle dispersion: 200 parts
Release agent dispersion: 106 parts
Rutile type titanium oxide dispersion: 90 parts
Anatase type titanium oxide dispersion: 10 parts
Polyammonium chloride (manufactured by TAIMEI CHEMICALS CO., LTD.): 5 parts A toner 11 and a developer 11 are prepared in the same manner as in Example 1 except that the above components are used, and the evaluation is performed in the same manner as in Example 1. The obtained results are shown in Table 1.

Example 12

A toner 12 and a developer 12 are prepared in the same manner as in Example 11 except that 70 parts of the rutile type titanium oxide dispersion and 30 parts of the anatase type titanium oxide dispersion are used, and the evaluation is performed in the same manner as in Example 1. The obtained results are shown in Table 1.

Example 13

A toner 13 and a developer 13 are prepared in the same manner as in Example 11 except that the 50 parts of the rutile type titanium oxide dispersion and 50 parts of the anatase type titanium oxide dispersion are used, and the evaluation is performed in the same manner as in Example 1. The obtained results are shown in Table 1.

Example 14

A toner 14 and a developer 14 are prepared in the same manner as in Example 11 except that the 95 parts of the rutile type titanium oxide dispersion and 5 parts of the anatase type titanium oxide dispersion are used, and the evaluation is performed in the same manner as in Example 1. The obtained results are shown in Table 1.

Example 151

A toner 15 and a developer 15 are prepared in the same manner as in Example 11 except that the 40 parts of the rutile type titanium oxide dispersion and 60 parts of the anatase type titanium oxide dispersion are used, and the evaluation is performed in the same manner as in Example 1. The obtained results are shown in Table 1.

Comparative Example 1

Amorphous resin particle dispersion 1: 200 parts
Amorphous resin particle dispersion 2: 200 parts
Crystalline polyester resin particle dispersion: 110 parts
Release agent dispersion: 80 parts
Rutile type titanium oxide dispersion: 200 parts
Polyammonium chloride (manufactured by TAIMEI CHEMICALS CO., LTD.): 5 parts A toner 16 and a developer 16 are prepared in the same manner as in Example 1 except that the above components are used, and the evaluation is performed in the same manner as in Example 1. The obtained results are shown in Table 1.

Comparative Example 2

Amorphous resin particle dispersion 1: 200 parts
Amorphous resin particle dispersion 2: 200 parts
Crystalline polyester resin particle dispersion: 110 parts
Release agent dispersion: 80 parts
Anatase type titanium oxide dispersion: 200 parts
Polyammonium chloride (manufactured by TAIMEI CHEMICALS CO., LTD.): 5 parts A toner 17 and a developer 17 are prepared in the same manner as in Example 1 except that the above components are used and the evaluation is performed in the same manner as in Example 1. The obtained results are shown in Table 1.

TABLE 1

| | Rutile type titanium oxide ratio | Anatase type titanium oxide ratio | Colorant amount % by mass | Image cracking | Whiteness |
|---|---|---|---|---|---|
| Example 1 | 90 | 10 | 40 | B | B |
| Example 2 | 70 | 30 | 40 | A | A |
| Example 3 | 50 | 50 | 40 | B | B |
| Example 4 | 95 | 5 | 40 | C | C |
| Example 5 | 40 | 60 | 40 | C | C |
| Example 6 | 90 | 10 | 70 | C | B |
| Example 7 | 70 | 30 | 70 | C | B |
| Example 8 | 50 | 50 | 70 | C | B |
| Example 9 | 95 | 5 | 70 | C | B |
| Example 10 | 40 | 60 | 70 | C | B |
| Example 11 | 90 | 10 | 20 | B | C |
| Example 12 | 70 | 30 | 20 | B | C |
| Example 13 | 50 | 50 | 20 | B | C |
| Example 14 | 95 | 5 | 20 | B | C |
| Example 15 | 40 | 60 | 20 | B | C |
| Comparative example 1 | 100 | 0 | 40 | D | C |
| Comparative example 2 | 0 | 100 | 40 | C | D |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

a binder resin; and a white colorant dispersed in the toner, wherein the colorant includes a rutile type titanium oxide and an anatase type titanium oxide, and wherein the total amount of rutile type titanium oxide and anatase type titanium oxide of the total amount of colorants is from 80% to 100% by weight.

2. The electrostatic charge image developing toner according to claim 1, wherein a mass ratio between the rutile type titanium oxide and the anatase type titanium oxide is 90:10 to 50:50.

3. The electrostatic charge image developing toner according to claim 1, wherein the amount of the colorant is from about 30% by mass to about 60% by mass based on the total mass of the toner.

4. The electrostatic charge image developing toner according to claim 1, wherein a mass ratio between the rutile type titanium oxide and the anatase type titanium oxide is 80:20 to 60:40.

5. The electrostatic charge image developing toner according to claim 1, wherein the volume average particle size of the rutile type titanium oxide and the anatase type titanium oxide is from about 100 nm to about 400 nm.

6. The electrostatic charge image developing toner according to claim 1, wherein the volume average particle size of the rutile type titanium oxide and the anatase type titanium oxide is from about 200 nm to about 300 nm.

7. An electrostatic charge image developer comprising the electrostatic charge image developing toner according to claim 1.

8. The electrostatic charge image developer according to claim 7, further comprising a carrier.

9. The electrostatic charge image developer according to claim 7, wherein the electrostatic charge image developing toner contains a white colorant in which a mass ratio between the rutile type titanium oxide and the anatase type titanium oxide is 90:10 to 50:50.

10. The electrostatic charge image developer according to claim 7, wherein the electrostatic charge image developing toner contains a colorant in which the volume average particle size of the rutile type titanium oxide and the anatase type titanium oxide is from about 100 nm to about 400 nm.

11. A process cartridge accommodating the electrostatic charge image developer according to claim 7, comprising a developing unit that develops an electrostatic charge image formed on the surface of a latent image holding member by using the electrostatic charge image developer to form a toner image, and being detachable from an image forming apparatus.

12. An image forming apparatus comprising:

a latent image holding member;

a charging unit that charges the surface of the latent image holding member;

an electrostatic charge image forming unit that forms an electrostatic charge image on the surface of the latent image holding member;

a developing unit that develops the electrostatic charge image by using the electrostatic charge image developer according to claim 8 to form a toner image;

a transfer unit that transfers the toner image to a recording medium; and a fixing unit that fixes the toner image to the recording medium.

13. The image forming apparatus according to claim 12, wherein the electrostatic charge image developing toner contains a white colorant in which a mass ratio between the rutile type titanium oxide and the anatase type titanium oxide is 90:10 to 50:50.

14. The image forming apparatus according to claim 12, wherein the electrostatic charge image developing toner contains a colorant in which the volume average particle size of the rutile type titanium oxide and the anatase type titanium oxide is from about 100 nm to about 400 nm.

15. An image forming method comprising:

charging the surface of a latent image holding member;

forming an electrostatic charge image on the surface of the latent image holding member;

developing the electrostatic charge image by using the electrostatic charge image developer according to claim 8 to form a toner image;

transferring the toner image to a recording medium; and fixing the toner image to the recording medium.

16. The image forming method according to claim 15, wherein the electrostatic charge image developing toner contains a white colorant in which a mass ratio between the rutile type titanium oxide and the anatase type titanium oxide is 90:10 to 50:50.

17. The image forming method according to claim 15, wherein the electrostatic charge image developing toner contains a colorant in which the volume average particle size of the rutile type titanium oxide and the anatase type titanium oxide is from about 100 nm to about 400 nm.

18. A toner cartridge comprising the electrostatic charge image developing toner according to claim 1 inside a container thereof and being detachable from an image forming apparatus.

19. The electrostatic charge image developing toner according to claim 1, wherein the colorant is present in the toner in an amount of from about 40% by mass to about 60% by mass based on a total amount of the toner.

* * * * *